US007903044B2

(12) United States Patent
Leisten

(10) Patent No.: US 7,903,044 B2
(45) Date of Patent: Mar. 8, 2011

(54) DIELECTRICALLY-LOADED ANTENNA

(75) Inventor: Oliver Paul Leisten, Northampton (GB)

(73) Assignee: Sarantel Limited, Wellingborough (GB)

( * ) Notice: Subject to any disclaimer, the term of this patent is extended or adjusted under 35 U.S.C. 154(b) by 213 days.

(21) Appl. No.: 11/970,740

(22) Filed: Jan. 8, 2008

(65) Prior Publication Data

US 2009/0167630 A1 Jul. 2, 2009

Related U.S. Application Data

(60) Provisional application No. 60/920,928, filed on Mar. 30, 2007.

(30) Foreign Application Priority Data

Jan. 8, 2007 (GB) ..... 0700276.9

(51) Int. Cl.
*H01Q 1/36* (2006.01)

(52) U.S. Cl. ..... 343/895; 343/850

(58) Field of Classification Search ..... 343/895, 343/702, 700 MS, 850, 853
See application file for complete search history.

(56) References Cited

U.S. PATENT DOCUMENTS

| | | | | |
|---|---|---|---|---|
| 3,503,075 | A | 3/1970 | Gerst | |
| 4,008,479 | A | 2/1977 | Smith | |
| 4,011,567 | A | 3/1977 | Ben-Dov | |
| 5,828,348 | A * | 10/1998 | Tassoudji et al. | 343/895 |
| 5,990,847 | A | 11/1999 | Filipovic et al. | |
| 6,072,441 | A * | 6/2000 | Tanabe | 343/895 |
| 6,278,415 | B1 * | 8/2001 | Matsuyoshi et al. | 343/895 |
| 6,421,029 | B1 * | 7/2002 | Tanabe | 343/895 |
| 6,608,604 | B1 | 8/2003 | Sharaiha et al. | |
| 6,886,237 | B2 * | 5/2005 | Leisten et al. | 29/600 |
| 7,002,530 | B1 * | 2/2006 | Chung et al. | 343/895 |
| 2003/0184496 | A1 | 10/2003 | Louvigne et al. | |
| 2006/0125712 | A1 | 6/2006 | Sharaiha et al. | |

FOREIGN PATENT DOCUMENTS

| | | |
|---|---|---|
| EP | 0 427 654 | 5/1991 |
| EP | 1 041 671 | 10/2000 |
| EP | 0 896 385 B1 | 10/2001 |
| EP | 0 917 241 | 6/2002 |
| EP | 1 643 594 | 4/2006 |
| GB | 2 292 638 | 2/1996 |
| GB | 2 309 592 | 7/1997 |
| GB | 2 310 543 | 8/1997 |
| GB | 2 317 057 | 3/1998 |

(Continued)

OTHER PUBLICATIONS

S.H. Zainud-Deen et al.; *Investigation of an Octafliar Helix Antenna*; Nineteenth National Radio Science Conference; Mar. 19-21, 2002; pp. 72-80; Alexandria.

(Continued)

*Primary Examiner* — Hoang V Nguyen
(74) *Attorney, Agent, or Firm* — Alston & Bird LLP

(57) ABSTRACT

A dielectrically loaded multifilar helical antenna having an operating frequency in excess of 200 MHz has an electrically insulative core with a relative dielectric constant greater than 5 occupying the major part of the interior volume defined by a three dimensional antenna element structure having, in one embodiment, eight coextensive helical tracks and, in another embodiment, six such tracks. The antennas are backfire or endfire antennas, all helical elements being phased so as to contribute to a circular polarization resonance at the operating frequency.

28 Claims, 11 Drawing Sheets

FOREIGN PATENT DOCUMENTS

| | | |
|---|---|---|
| GB | 2 338 605 | 12/1999 |
| GB | 2 346 014 | 7/2000 |
| GB | 2 351 850 | 1/2001 |
| GB | 2 367 429 | 4/2002 |
| GB | 2 399 948 A | 9/2004 |
| GB | 2 419 037 | 4/2006 |
| GB | 2 424 521 | 9/2006 |
| WO | WO 2006/045769 | 5/2006 |
| WO | WO 2006/136809 | 12/2006 |
| WO | WO 2006/136810 | 12/2006 |

OTHER PUBLICATIONS

British Search Report for GB 0700276.9; Filed Jan. 8, 2007.

The British Search Report for Application No. GB 0800222.2; Date of Search Apr. 18, 2008.

* cited by examiner

DIELECTRICALLY-LOADED ANTENNA

CROSS-REFERENCE TO RELATED APPLICATION

This application claims the benefit of the filing date of U.S. Provisional Patent Application Ser. No. 60/920,928 filed on Mar. 30, 2007, the entire disclosure of which is incorporated herein by reference.

FIELD OF THE INVENTION

This invention relates to a dielectrically-loaded antenna for operation at frequencies in excess of 200 MHz and a portable wireless terminal incorporating such an antenna.

BACKGROUND OF THE INVENTION

Such antennas are disclosed in a number of patent publications of the present applicant, including GB2292638A, GB2309592A, GB2310543A, GB2338605A, GB2346014A GB2351850A and GB2367429A. Each of these antennas has at least one pair of diametrically opposed helical antenna elements which are plated on a substantially cylindrical electrically insulative core made of a material having a relative dielectric constant greater than 5. The material of the core occupies the major part of the volume defined by the core outer surface. Extending through the core from one end face to an opposite end face is an axial bore containing a coaxial feed structure that comprises an inner conductor surrounded by a shield conductor. At one end of the bore the feed structure conductors are connected to respective antenna elements which have associated connection portions adjacent the end of the bore. At the other end of the bore, the shield conductor is connected to a conductor which links the antenna elements and, in each of these examples, is in the form of a conductive sleeve encircling part of the core to form a balun. Each of the antenna elements terminates on a rim of the sleeve and each follows a respective helical path from its connection to the feed structure.

Some of the above prior patent publications disclose quadrifilar helical antennas intended primarily for receiving or transmitting circularly polarised electromagnetic waves. Each of these antennas has four helical tracks plated on the cylindrical surface of the core, or four groups of helical tracks, each group forming a composite antenna element and comprising two tracks separated by a narrow slit.

Whether the antenna has four helical antenna elements or two, the connection portions connecting the antenna elements to the feed structure conductors are radial tracks plated on a planar end surface of the core.

It is known to provide a quadrifilar helical antenna with an impedance matching network. This may be embodied as a small printed circuit or laminate board secured to the top end face of the core where it provides coupling between the feed structure and radial connection portions such as those disclosed in the above mentioned prior patent publications. An antenna having such a matching network is disclosed in our co-pending U.S. patent application Ser. No. 11/472,587. The disclosures of this application and each of the prior patent publications referred to above are specifically incorporated in this specification by reference.

It is an object of the invention to provide an improved dielectrically-loaded antenna.

SUMMARY OF THE DISCLOSURE

According to a first aspect of the present disclosure, a dielectrically-loaded antenna having an operating frequency in excess of 200 MHz comprises: an electrically insulative core of a solid material that has a relative dielectric constant greater than 5 and occupies the major part of the interior volume defined by the core outer surface, and a three-dimensional antenna element structure that is on or adjacent the core outer surface and comprises at least six elongate conductive elongate conductive antenna elements. The antenna elements are typically substantially axially coextensive and substantially uniformly spaced apart around an axis of the antenna, the elements being arranged in pairs, each juxtaposed so as to be on diametrically opposite sides of the axis. The antenna is resonant in a circularly polarised mode of resonance at the operating frequency, the resonant mode being characterised by a rotating dipole, and voltage maxima being excited on each of the elongate antenna elements in succession in the direction of rotation.

The preferred antenna includes a pair of antenna element coupling nodes, each of the said pairs of elements having one antenna element connected to one of the coupling nodes and another antenna element connected to the other coupling node. The preferred antenna also has a common interconnecting conductor for the elongate antenna elements, advantageously in the form of a conductive ring interconnecting ends of the elongate conductive elements. This conductor may encircle the axis and lie generally in plane extending perpendicularly to the axis. Preferably, this interconnecting conductor encircles the core on the outer side surface portion of the latter and defining a conductive path around the core. Each elongate antenna element has a first end connected to one or other of the coupling nodes and a second end connected to the common interconnecting conductor, the connections of the second ends being at equally spaced connection points.

Advantageously the electrical length of the conductive path formed by the common interconnecting conductor is substantially equal to a whole number (1, 2, 3, . . . ) of guide wavelengths corresponding to the operating frequency of the antenna. This enhances the circularly polarised resonant mode of the antenna since the common interconnecting conductor has a ring resonance at the operating frequency, promoting the progression of the rotating dipole around the uniformly spaced-apart elongate antenna elements.

The common interconnecting conductor may be a narrow annular conductive track, both edges of which are on the outer side surface portion of the core. Such a configuration is particularly suitable for an endfire multifilar helical antenna. Alternatively, the common interconnecting conductor may be constituted by a conductive sleeve that surrounds the core and extends over an end surface portion to make a connection with the shield conductor of a coaxial transmission line feeder. This feeder passes through the core to connections with the elongate antenna elements at an opposite end surface portion of the core. Such a sleeve may form an integral balun, as described in the above-referenced prior patent applications of the present applicant.

The ends of the elongate antenna elements are preferably equiangularly spaced around the central axis, the physical spacings being equal to the differences in phase between voltages and currents on the respective elements. In general, the physical angular spacing between successive elongate antenna elements does not vary by more than 2:1, at both the ends of the helices and at locations between their ends.

In one embodiment of the invention, the elongate antenna elements are helices of substantially equal length. Especially with a common interconnecting conductor exhibiting a ring resonance at the operating frequency, phasing of the currents and voltages in the elongate antenna elements is not entirely dependent on the electrical lengths of such elements. In other embodiments, however, phasing of the elements may be achieved by arranging for the common interconnecting conductor to follow a non-planar path, so that the above-mentioned second ends of the antenna elements of each group of elements, which have their first ends connected to a respective one of the coupling nodes, are at different distances from the first ends, the nature of the variation of such distances in a given direction of rotation about a central axis of the antenna depending on the arrangement of connections between the first ends of the elements and the respective coupling nodes. It has been found, in particular, that edge effects in the arrangement of the connections tend to favour a non-monotonic progression of element lengths so that, for instance, elements which constitute inner elements of their respective groups are longer than the outer elements. However, it is also possible for the second ends of the antenna elements of each group to be progressively closer to the first ends in a given direction of rotation about a central axis of the antenna. In particular, the conductive path provided by the common interconnecting conductor may be inclined or progressively stepped in a first direction between each of the antenna elements of each group of such elements connected at their first ends to a respective one of the coupling nodes, and inclined or stepped in the opposite direction between the groups. Thus, in this instance, the conducting path may be regarded as having two peaks and two troughs, the peaks and troughs occurring alternately and the slopes between the peaks and troughs being such that the two slopes in the first direction are much less steep than the two slopes in the opposite direction.

In one preferred embodiment each elongate antenna element has its first end coupled to its respective coupling node and its second end spaced from the first end, the element being dimensioned to yield a predetermined electrical path length between the respective coupling node and the second end. The elongate antenna elements coupled to each node form a group of neighbouring elements which are arranged so as to be angularly spaced apart with respect to the axis and such that their respective electrical path lengths differ and thereby form a monotonic progression, the sense of the progression being the same for each group.

The second ends of the antenna elements are preferably linked. Thus, in the preferred embodiments, each elongate antenna element of each pair of such elements has a first end coupled to a respective one of the coupling nodes and the second end which is linked to the second end of the other elongate antenna element of the pair to form at least part of a conductive loop that is generally symmetrical about the axis and that has a predetermined resonant frequency. The loops formed by such pairs of elongate antenna elements are angularly distributed with respect to the axis, the respective resonant frequencies of the loops varying monotonically with angular orientation about the axis. In such a case, the second ends of the elongate antenna elements may be linked by the common interconnecting conductor encircling the core, such that their second ends are defined by the connections of the elements to a common annular edge of the interconnecting conductor, which edge, in terms of its axial position, varies in height non-monotonically across each group of elongate antenna elements.

It will be noted that in preferred embodiments of the invention phasing of currents and voltages on the helical antenna elements is achieved by conductors on the core, rather than using an external network.

The preferred embodiments of the invention each take the form of an octafilar helical antenna having four pairs of elongate helical antenna elements on a cylindrical surface portion of the core, the angular spacing of neighbouring such elements being 45° at the cylinder axis. Preferably, each helical element executes a half turn about the axis, although quarter-turn elements may be used. In general, the elements may execute M/4 turns where M is an integer (1, 2, 3 . . . ).

The helical elements preferably comprise conductive tracks on the core outer side surface portion. They may be pure helices or they may deviate from a pure helical path, e.g. by being meandered. It is also possible to alter their electrical length, in each case, by meandering, for instance, only one of the edges, or by meandering the two edges of the track to different amplitudes. It is to be noted that efficiency of the antenna is greater than that associates with an equivalent quadrifilar antenna because the number of conductive track edges of the radiating structure is greater. At typical operating frequencies of such antennas, currents tend to be confined to the edges or peripheries of conductors. It follows that increasing the number of edges connected in parallel reduces ohmic losses and hence increases efficiency. This gain in efficiency can be used to yield improved sensitivity for receiving equipment and greater effective transmitted power for transmitting equipment. Alternatively, it can be used to provide antennas which are smaller than prior antennas of a given efficiency. Thus, for instance, where dielectrically loaded antennas of 10 mm diameter have been used for a predetermined purpose, antennas such as those described in this specification can be made with a diameter of 7.5 mm, with no significant loss in efficiency. In such a case the relative dielectric constant of the core material is typically in the range of from 50 to 100.

In one embodiment of the invention, the elongate antenna elements connected to each of the above-mentioned coupling nodes comprise a group of antenna elements spaced apart laterally with respect to each other and having two outer elements and at least one inner element between the outer elements of the group, the or each inner element having a greater electrical length than the outer element. Such a configuration is particularly applicable to an antenna in which radial connection portions on an end surface of the core are used to connect the coupling nodes to the respective elongate antenna elements.

In the case where the antenna element structure comprises an odd number of pairs of elongate antenna elements, each group of elements, coupled to a respective coupling node, has a middle antenna element and outer elements. The middle antenna element has an associated resonance at a frequency which is midway between the frequencies of resonances associated respectively with the antenna elements of the group which are on each respective side of the middle element. It has been found that an odd number of pairs of elongate conductive antenna elements has advantages in terms of bandwidth, especially in the case of an antenna having six helical antenna elements.

In preferred embodiments of the invention, the relative dielectric constant of the core material is greater than 10 and, more preferably, greater than 20.

According to a second aspect of the present disclosure, the portable wireless communication terminal includes an antenna as described above and a generally planar circuit board having an electrically conductive layer, wherein such a layer has an edge adjacent the antenna element structure of the antenna and extends generally radially outwardly from the core of the antenna with respect to the antenna axis. The conductive layer may lie in a plane generally parallel to the axis or in a plane containing the axis. Such an arrangement is advantageous in terms of the detuning effect of the electrically conductive layer of the circuit board on the antenna, the presence of at least three pairs of elongate conductive antenna elements being less susceptible to detuning than those of a multifilar helical antenna having fewer elements to the extent that the conductive layer can typically extend relatively close to the antenna surface over the axial length of the elements, e.g. typically significantly closer than 3 mm and, in the preferred communication terminal in accordance with the invention, to within 1 mm of the antenna element structure.

The invention will now be described below by way of example with reference to the drawings.

DETAILED DESCRIPTION OF THE DRAWINGS

Figure 1:
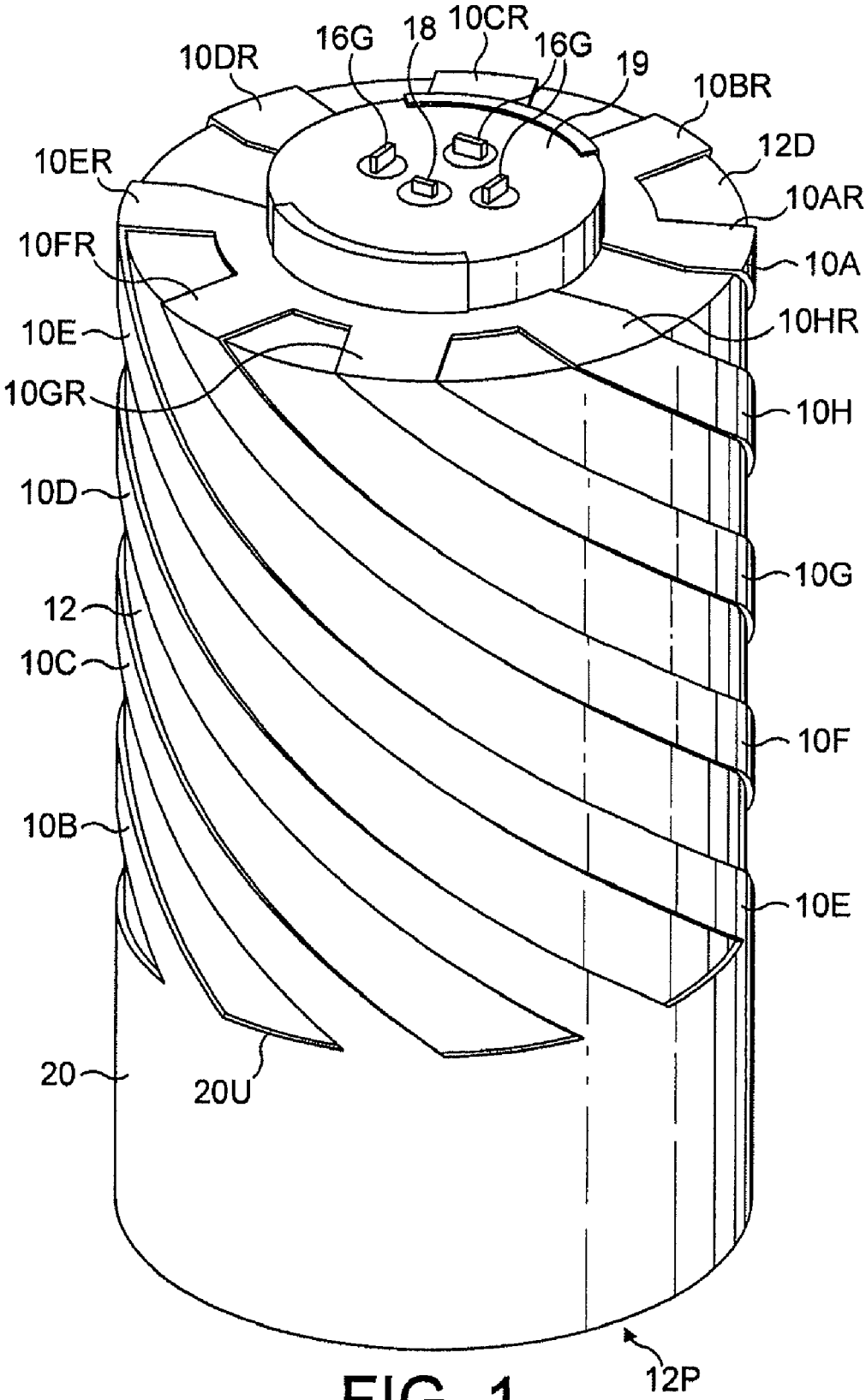
FIG. 1 is a perspective view of a first antenna in accordance with the invention.
Figure 2:
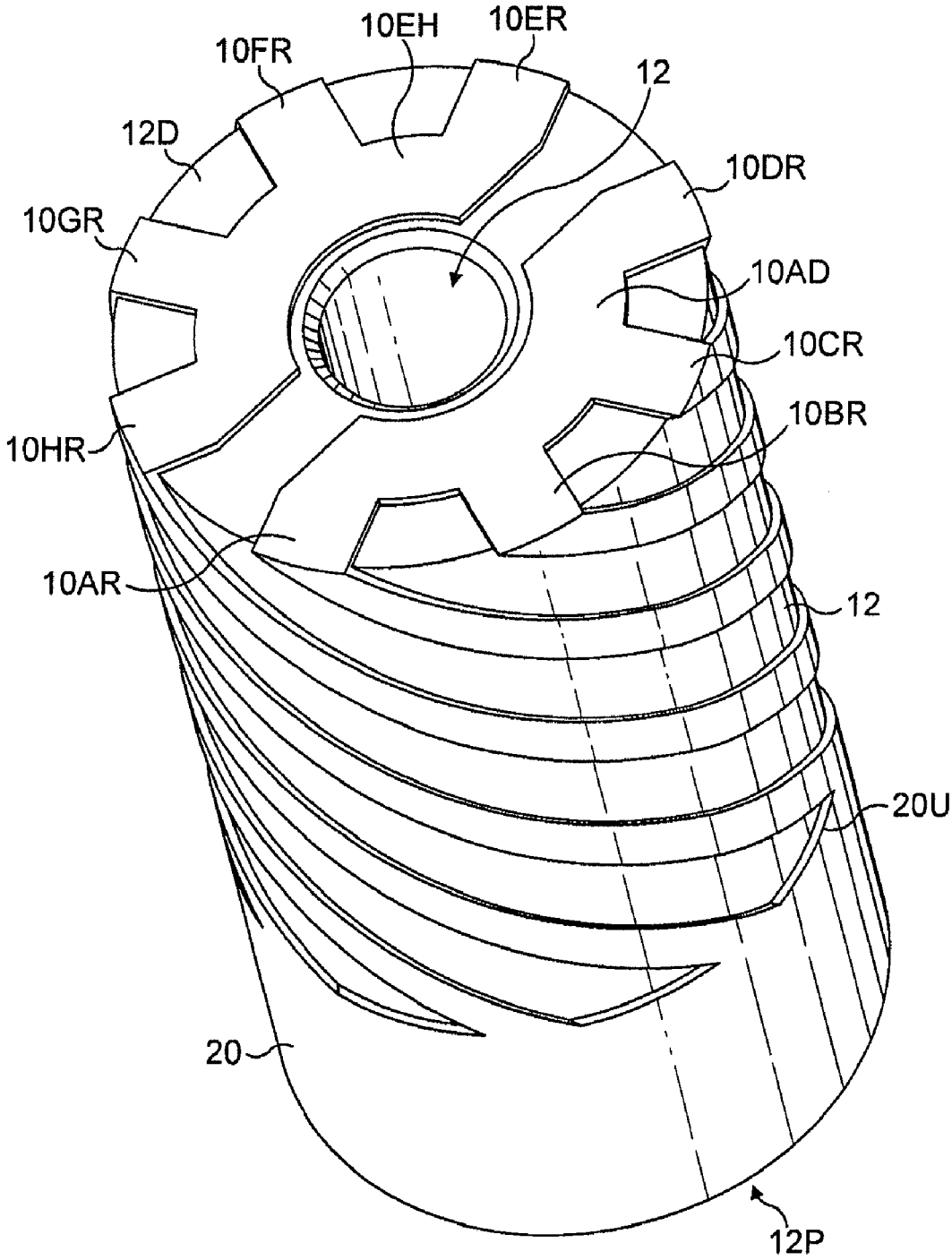
FIG. 2 is a perspective view of a plated antenna core of the antenna of FIG. 1, viewed from a distal end and one side.

Referring to FIGS. 1 and 2, an octafilar helical antenna in accordance with the invention has an antenna element structure with eight elongate antenna elements in the form of eight axially coextensive helical conductive tracks 10A, 10B, 10C, 10D, 10E, 10F, 10G, 10H plated or otherwise metallised on the cylindrical outer surface of a cylindrical core 12. The core is made of a ceramic material. In this case it is a barium titanate material having a relative dielectric constant of in the region of 36. This material is noted for its dimensional and electrical stability with varying temperature. Dielectric loss is generally negligible. In this embodiment, the core has a diameter of 10 mm. The length of the core is greater than the diameter but, in other embodiments of the invention, it may be less. The core is produced by pressing, but may be produced in an extrusion process, the core then being fired.

Figure 3:
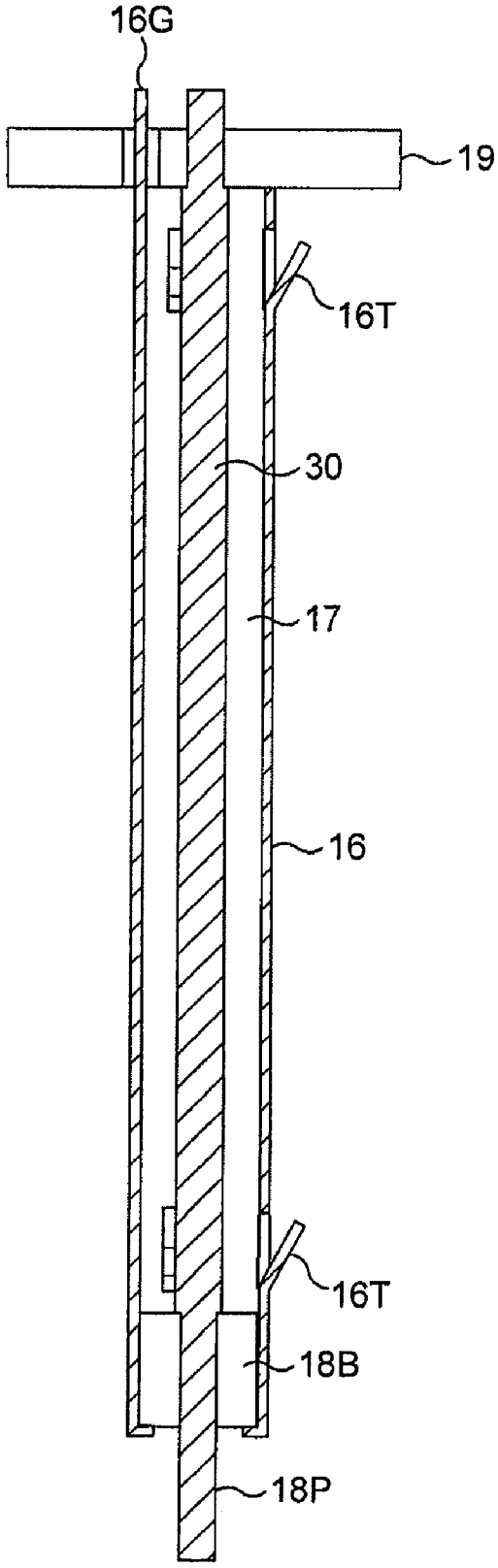
FIG. 3 is an axial cross-section of a feed structure of the antenna of FIG. 1.

This preferred antenna is a backfire helical antenna in that it has a coaxial transmission line housed in an axial bore 12B that passes through the core from a distal end face 12D to a proximal end face 12P of the core. Both end faces 12D, 12P are planar and perpendicular to the central axis of the core. They are oppositely directed, in that one is directed distally and the other proximally in this embodiment of the invention. The coaxial transmission line is a rigid coaxial feeder which is housed centrally in the bore 12B with the outer shield conductor spaced from the wall of the bore 12B so that there is, effectively, a dielectric layer between the shield conductor and the material of the core 12. Referring to FIG. 3, the coaxial transmission line feeder has a conductive tubular outer shield 16, a first tubular air gap or insulating layer 17, and an elongate inner conductor 18 which is insulated from the shield by the insulating layer 17. The shield 16 has outwardly projecting and integrally formed spring tangs 16T or spacers which space the shield from the walls of the bore 12B. A second tubular air gap exists between the shield 16 and the wall of the bore 12B. The insulative layer 17 may, instead, be formed as a plastics sleeve, as may the layer between the shield 16 and the walls of the bore 12B. At the lower, proximal end of the feeder, the inner conductor 18 is centrally located within the shield 16 by an insulative bush 18B, as described in our co-pending U.S. patent application Ser. No. 11/472,587.

The combination of the shield 16, inner conductor 18 and insulative layer 17 constitutes a transmission line of predetermined characteristic impedance, here 50 ohms, passing through the antenna core 12 for coupling distal ends of the antenna elements 10A to 10H to radio frequency (RF) circuitry of equipment to which the antenna is to be connected. The couplings between the antenna elements 10A to 10H and the feeder are made via conductive connection portions associated with the helical tracks 10A to 10H, these connection portions being formed as radial tracks 10AR, 10BR, 10CR, 10DR, 10ER, 10FR, 10GR, 10HR plated on the distal end face 12D of the core 12. Each connection portion extends from a distal end of the respective helical track to one of two arcuate conductors 10AD, 10EH plated on the core distal face 12D adjacent the end of the bore 12B.

The two arcuate conductors 10AD, 10EH are connected, respectively, to the shield and inner conductors 16, 18 by conductors on a laminate board 19 secured to the core distal face 12D, as will described hereinafter. The coaxial transmission line feeder and the laminate board 19 together comprise a unitary feed structure before assembly into the core 12, and their interrelationship may be seen by comparing FIGS. 1, 2 and 3.

Referring to FIG. 3, the inner conductor 18 of the transmission line feeder has a proximal portion 18P which projects as a pin from the proximal face 12P of the core 12 for connection to the equipment circuitry. Similarly, integral lugs (not shown) on the proximal end of the shield 16 project beyond the core proximal face 12P for making a connection with the equipment circuitry ground.

The proximal ends of the antenna elements 10A-10H are connected to a common virtual ground conductor 20. In this embodiment, the common conductor is annular and in the form of a plated sleeve surrounding a proximal end portion of the core 12. This sleeve 20 is, in turn, connected to the shield conductor 16 of the feeder by a plated conductive covering (not shown) of the proximal end face 12P of the core 12.

The eight helical antenna elements 10A-10H constitute four pairs 10A, 10E; 10B, 10F; 10C; 10G; 10D, 10H of such elements, each pair having one helical element coupled to one of the arcuate conductors 10AD, 10EH and another element coupled to the other of the arcuate conductors 10EH, 10AD, and thence, respectively, to the inner conductor 18 and shield 16 of the transmission line feeder. In effect, therefore, the eight helical antenna elements 10A-10D may be regarded as being arranged in two groups of four 10A-10D, 10E-10H, all of the elements 10A-10D of one group being coupled to the first arcuate conductor 10AD and all of the elements 10E-10H of the other group being coupled to the second arcuate conductor 10EH. Thus, the two arcuate conductors constitute first and second coupling nodes that interconnect the respective helical antenna elements, and provide common connections for the elements of each group to one or other of the conductors of the transmission line feeder.

Figure 4:
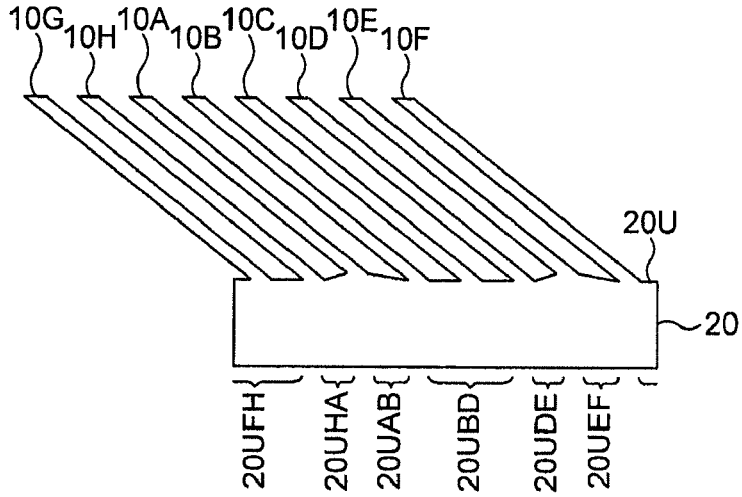
FIG. 4 is a representation of the conductor pattern on the outer cylindrical surface of the antenna of FIG. 1, transformed to a plane.

In this preferred embodiment of the invention, the eight helical antenna elements 10A-10H are of different lengths. More specifically, each pair of laterally opposed elements 10A, 10E; 10B, 10F; 10C, 10G; 10D, 10H has two elements of the same length, those of a first pair 10A, 10E being of a first length, those of a second pair 10B, 10F being of a second length, those of a third pair 10C, 10G being of a third length and those of the remaining fourth pair 10D, 10H being of a fourth length. It has been found that, in order to obtain a progression of individual resonant frequencies, one of the outermost elements of each group, in this case elements 10A and 10E, should be shorter than the others. Preferably, the physical length of the other elements 10B, 10F; 10C, 10G; 10D, 10H are substantially equal rather than being progressively greater in order to compensate for different path lengths in the conductive connection portions on the distal end face 12D of the core 12, i.e. the radial tracks 10AR-10HR and arcuate conductors 10AD, 10EH, best seen in FIG. 2, and associated edge effects at the frequency of operation of the antenna. These differences in length are achieved by arranging for the rim 20U of the sleeve 20 to be non-planar inasmuch as its distance from the distal end face 20D of the core varies according to the angular position around the central axis of the core. This is seen most clearly in the diagram of FIG. 4 which is a representation of the conductor pattern on the cylindrical outer surface of the core 12 shown as if the cylindrical surface has been transformed to a flat surface. In this transformed representation, each helical element 10A-10H appears as a straight conductor track. As will be seen, the sleeve 20 has a rim 20U with four inclined portions and two flat portions. These portions comprise a first portion 20UAB inclined in a first direction, a second flat portion 20UBD which is generally parallel to the edge of the distal end 12D (FIG. 2) and joined to the first portion, a third portion 20UDE inclined in a second direction and joined to the second portion, a fourth portion 20UEF again inclined in the first direction and joined to the third portion, a fifth portion 20UFH parallel to the distal end 12D and, to complete the annulus around the core, a sixth portion 20UHA inclined in the second direction and joining the fifth and first portions. By connecting the proximal ends of the elements 10A-10D of the first group to the rim at equally spaced intervals, as shown in FIG. 4, their lengths are varied as described above. The identical juxtaposition of the proximal ends of the elements 10E-10H of the second group and the rim yields the same length variations. It will be appreciated that, instead of following an inclined slope, each inclined rim portion may instead be stepped to achieve the same length differences in the helical elements 10A-10H.

Figure 5:
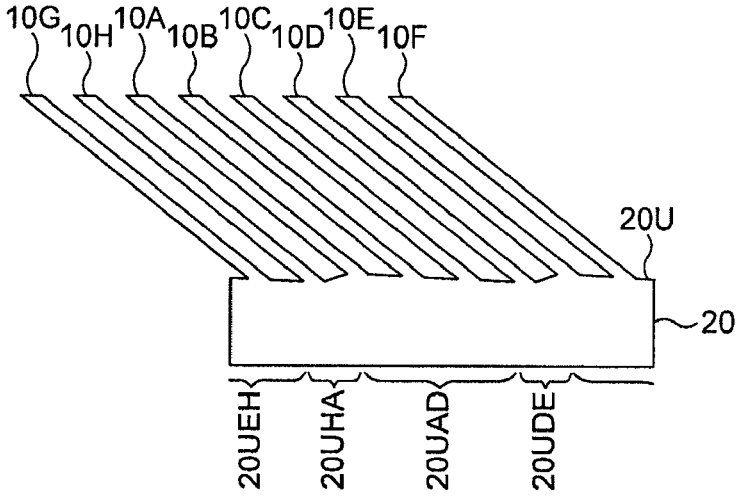
FIG. 5 is a similar representation of an alternative conductor pattern.

In an alternative octafilar antenna in accordance with the invention, the lengths of the antenna elements of each group may vary monotonically with rotation around the core 12. Such an arrangement is shown in FIG. 5. In this case, the rim 20U has four inclined portions comprising a first portion 20UAD inclined in a first direction, a second portion 20UDE inclined in a second direction and joined to the first portion, a third portion 20UEH inclined in the first direction and joined to the second portion, and, to complete the annulus around the core, a fourth portion 20UHA inclined in the second direction and joining the third and first portions. In this way, the length of the elements 10A-10D of the first group are made progressively greater in sequence. Similarly, the identical juxtaposition of the proximal elements of the elements 10E-10H of the second group and the third rim portion also yield a progressively increasing element length. It will be evident that, in this case, the slope of the second and fourth rim portions 20UDE, 20UHA is steeper than the slopes of the first and third portions 20UAD, 20UEH owing to the uniform spacing of the helical elements 10A-10H around the core 12.

In summary, therefore, the helical elements 10A-10H of this preferred antenna are equally angularly spaced around the core 12 at intervals of 360°/N where N is the number of elements, and they are arranged in two groups each having N/2 elements that are of varying length owing to the varying distance of the rim 20U of the sleeve 20 from the distal end face 12D of the core 12, which face is perpendicular to the central axis of the core. Each element executes substantially a half turn of the core in this embodiment, although alternative embodiments may employ elements having other integral multiples (1, 2, 3, . . . ) of a half turn or, indeed, may be quarter turn helices or multiples thereof.

The conductive sleeve 20, the plating on the proximal end face 12P of the core, and the outer shield 16 of the feeder together form a quarterwave balun that provides common-mode isolation of the radiating antenna element structure from the equipment to which the antenna is connected when installed when the antenna is operated at its operating frequency. Currents in the sleeve are, therefore, confined to the sleeve rim 20U. Accordingly, at the operating frequency, the rim 20U of the sleeve 20 and the helical elements of each pair 10A, 10E-10D, 10H form a respective conductive loop connected to a balanced feed, currents travelling between the elements of each pair via the rim 20U.

In this preferred embodiment of the invention, the circumference of the sleeve is equal to an integer number of guide wavelengths at the operating frequency. This has the effect of reinforcing the resonant mode arising from the resonance of the above-mentioned conductive loops formed by the pairs of helical elements and the rim at the operating frequency. In particular, as described in the above-mentioned British Patent Publication GB2346014A, the sleeve 20 acts as a resonant structure in itself, independently of the helical elements 10A-10H. Thus, the rim 20U of the sleeve, having an electrical length equal to the operating wavelength, is resonant in a ring mode. Reinforcement of the resonant mode due to the loops formed by the pairs of helical elements and the rim 20U can be visualised by imagining a wave being injected onto the ring represented by the rim 20U at the junction of each of the helical elements and the rim, the wave then travelling around the rim 20U to form a spinning dipole, as described in GB2346014A. Owing to the electrical length of the rim 20U, when the injected wave has traveled around the rim 20U and arrives back at the injection point, the next wave is injected from the respective helical element, thereby reinforcing the first. This constructive combination of waves results from the resonant length of the rim.

Further details of the ring resonance and the action of the sleeve 20 and the plating on the proximal end surface 12P of the core in contributing to the operation of the antenna with regard to circularly polarised electromagnetic waves are contained in the above-mentioned GB2346014A. Whilst the sleeve and plating of this embodiment of the invention are advantageous in that they provide both a balun function and a ring resonance, a ring resonance can also be provided independently by connecting the helical elements 10A-10H to an annular conductor that encircles the core 12 and has both proximal and distal edges on the outer side surface portion of the core, rather than being in the form of a sleeve connected to the feeder shield conductor 16 to form an open-ended cavity, as in the present embodiment. Such a conductor may be comparatively narrow insofar as it may constitute an annular track the width of which is similar to the width of conductive tracks forming the helical elements 10A-10H and, providing it has an electrical length corresponding to an integral multiple (1, 2, 3, . . . ) of the guide wavelength at the operating frequency, still produces a ring resonance reinforcing the resonant mode associated with the loops provided by the helical elements and their interconnection. An antenna having an annular track of this description is described hereinafter.

With regard to the resonant behaviour of the loops represented by the helical elements 10A-10H and their interconnection, these combine such that at the operating frequency of the antenna, it operates in a mode of resonance in which the antenna is sensitive to circularly polarised signals. Each pair 10AE, 10BF, 10CG, 10DH of the helical elements has an associated resonance within a single operating frequency band of the antenna, and the pairs all co-operate to form a common circular polarisation resonance, as follows. The differing lengths of the antenna elements 10A-10H result in 360°/N (45°) phase differences between currents in the different elements of each group 10A-10D, 10E-10H. In this resonant mode, currents flow around the rim 20U between, on the one hand, the helical element of each pair 10AE, 10BF, 10CG, 10DH which is coupled to the inner feed conductor 18 and, on the other hand, that which is connected to the shield 16 by the coupling conductors of the laminate board 19, as will be described below. The sleeve 20 and the plating on the proximal end face 12P of the core together act as a trap preventing the flow of currents from the antenna elements 10A-10H to the shield conductor 16 at the proximal end face 12P of the core.

Operation of dielectrically loaded multifilar helical antennas having a balun sleeve is described in more detail in the above-mentioned British Patent Applications GB2292638A and GB2310543A.

The feeder transmission line performs functions other than simply as a line having a characteristic impedance of 50 ohms for conveying signals to or from the antenna element structure. Firstly, as described above, the shield 16 acts in combination with the sleeve 20 to provide common-mode isolation at the point of connection of the feed structure to the antenna element structure. The length of the shield conductor between (a) its connection with the plating 22 on the proximal end face 12P of the core and (b) its connection to conductors on the laminate board 19, together with the dimensions of the bore 12B and the dielectric constant of the material filling the space between the shield 16 and the wall of the bore, are such that the electrical length of the shield 16 on its outer surface is, at least approximately, a quarter wavelength at the frequency of the required mode of resonance of the antenna, so that the combination of the conductive sleeve 20, the plating 22 and the shield 16 promotes balanced currents at the connection of the feed structure to the antenna element structure.

In this preferred antenna, there is an insulative layer surrounding the shield 16 of the feed structure. This layer, which is of lower dielectric constant than the dielectric constant of the core 12, diminishes the effect of the core 12 on the electrical length of the shield 16 and, therefore, on any longitudinal resonance associated with the outside of the shield 16. Since the mode of resonance associated with the required operating frequency is characterised by voltage dipoles extending diametrically, i.e. transversely of the cylindrical core axis, the effect of the low dielectric constant sleeve on the required mode of resonance is relatively small due to the sleeve thickness being, at least in the preferred embodiment, considerably less than that of the core. It is, therefore, possible to cause the linear mode of resonance associated with the shield 16 to be de-coupled from the wanted mode of resonance.

The antenna has a main resonant frequency of 500 MHz or greater, the resonant frequency being determined by the effective electrical lengths of the helical antenna elements 10A-10H and, to a lesser degree, by their width. The lengths of the elements, for a given frequency of resonance, are also dependent on the relative dielectric constant of the core material, the dimensions of the antenna being substantially reduced with respect to an air-cored quadrifilar antenna.

The antenna is especially suitable for satellite telephony and messaging in the Iridium band of from 1613.8 to 1626.5 MHz. In this case, the core 12 has a diameter of about 10 mm and the longitudinally extending antenna elements 10A-10D have an average longitudinal extent (i.e. parallel to the central axis) of about 12 mm. The length of the conductive sleeve 20 is typically in the region of 5.5 mm. Precise dimensions of the antenna elements 10A to 10D can be determined in the design stage on a trial and error basis by undertaking eigenvalue delay measurements until the required phase differences are obtained. The diameter of the coaxial transmission line in the bore 12B is in the region of 2 mm.

An alternative antenna having the features described above with reference to FIGS. 1 to 4, is resonant at 1575 MHz, the frequency of the L-band GPS service. In this case the core is 7.5 mm in diameter, the antenna elements have an average longitudinal extent of about 7 mm, and the balun sleeve length is about 2 mm. The relative dielectric constant of the core material is higher in this case, typically 76.

Further details of the feed structure will now be described. The feed structure comprises the combination of a coaxial 50 ohm line 16, 17, 18 and the planar laminate board 19 connected to a distal end of the line. The laminate board 19 is a multiple-layer printed circuit board (PCB) that lies flat against the distal end face 12D of the core 12 in face-to-face contact. The largest dimension of the PCB 19 is smaller than the diameter of the core 12 so that the PCB 19 is fully within the periphery of the distal end face 12D of the core 12, as shown in FIG. 1.

Figure 6:
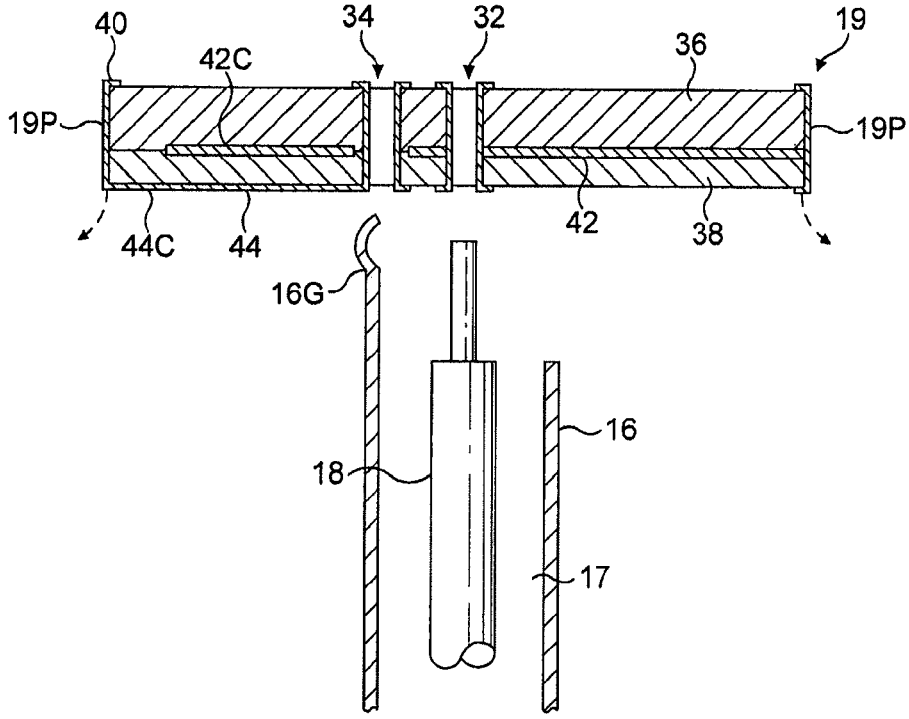
FIG. 6 is a detail of the feed structure shown in FIG. 4, showing a laminate board thereof detached from a distal end portion of a feeder transmission line.

In this embodiment, the PCB 19 is in the form of a disc centrally located on the distal face 12D of the core. Its diameter is such that it overlies the arcuate inter-element coupling conductors 10AD, 10EH plated on the core distal face 12D. As shown in FIG. 6, the PCB has a substantially central hole 32 which receives the inner conductor 18 of the coaxial feeder transmission line. Three off-centre holes 34 receive distal lugs 16G of the shield 16. Lugs 16G are bent or "jogged" to assist in locating the PCB 19 with respect to the coaxial feeder structure. All four holes 32 are plated through. In addition, portions 19P of the periphery of the PCB 19 are plated, the plating extending onto the proximal and distal faces of the board.

Figure 7A:
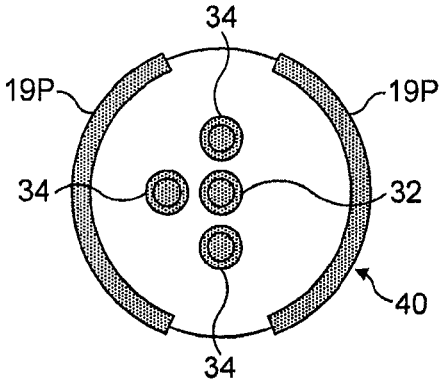
FIGS. 7A, 7B and 7C are diagrams showing conductor patterns of three conductive layers of the laminate board of the feeder structure.
Figure 7B:
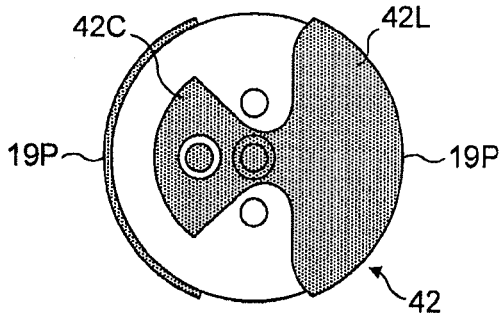
Figure 7C:
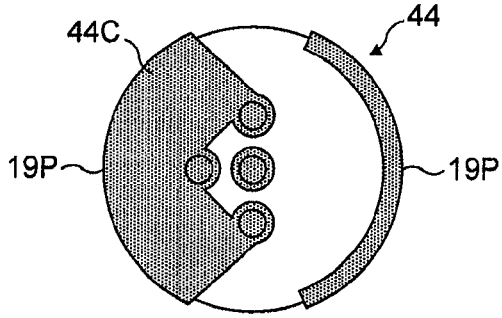

The PCB 19 is a multiple-layer board in that it has a plurality of insulative layers and a plurality of conductive layers. In this embodiment, the board has two insulative layers comprising a distal layer 36 and a proximal layer 38. There are three conductor layers as follows: a distal layer 40, an intermediate layer 42, and a proximal layer 44. The intermediate conductor layer 42 is sandwiched between the distal and proximal insulative layers 36, 38, as shown in FIG. 6. Each conductor layer is etched with a respective conductor pattern, as shown in FIGS. 7A to 7C. Where the conductor pattern extends to the peripheral portions 19P of the PCB 19 and to the plated-through holes 32, 34, the respective conductors in the different layers are interconnected by the edge plating and the hole plating respectively. As will be seen from the drawings showing the conductor patterns of the conductor layers 40, 42 and 44, the intermediate layer 42 has a first conductor area 42C in the shape of a fan or sector extending radially from a connection to the inner conductor 18 (when seated in hole 32) in the direction of the radial antenna element connection portions 10AR-10DR. Directly beneath this conductive area 42C, the proximal conductor layer 44 has a generally sector-shaped area 44C extending from a connection with the shield 16 of the feeder (when received in plated via 34) to the board periphery 19P overlying the arcuate or part-annular track 10AD interconnecting the radial connection elements 10AR-10DR. In this way, a shunt capacitor is formed between the inner feeder conductor 18 and the feeder shield 16, the material of the proximal insulative layer 38 acting as the capacitor dielectric. This material typically has a dielectric constant greater than 5.

The conductor pattern of the intermediate conductive layer 42 is such that it has a second conductor area 42L extending from the connection with the inner feeder conductor 18 to the second plated outer periphery 19P so as to overlie the arcuate or part-annular track 10EH. There is no corresponding underlying conductive area in the conductor layer 44. The conductive area 42L between the central hole 32 and the plated peripheral portion 19P overlying the arcuate track 10EH acts as a series inductance between the inner conductor 18 of the feeder and one of the groups of helical antenna elements 10E-10H.

When the combination of the PCB 19 and the elongate feeder 16-18 is mounted to the core 12 with the proximal face of the PCB 19 in contact with the distal face 12D of the core, aligned over the arcuate interconnection elements 10AD and 10EH as described above, connections are made between the peripheral portions 19P and the underlying tracks on the core distal face 12D to form a reactive matching circuit having a shunt capacitance and a series inductance.

The proximal insulative layer of the PCB 19 is formed of a ceramic-loaded plastics material to yield a relative dielectric constant for the layer 38 in the region of 10. The distal insulative layer 36 can be made of the same material or one having a lower dielectric constant, e.g. FR-4 epoxy board. The thickness of the proximal layer 38 is much less than that of the distal layer 36. Indeed, the distal layer 36 may act as a support for the proximal layer 38.

Connections between the feeder line 16-18, the PCB 19 and the conductive tracks on the distal face 12D of the core are made by soldering or by bonding with conductive glue. The feeder 16-18 and the PCB 19 together form a unitary feeder structure when the distal end of the inner conductor 18 is soldered in the via 32 of the PCB 19, and the shield lugs 16G in the respective off-centre vias 34. The feeder 16-18 and the PCB 19 together form a unitary feed structure with an integral matching network.

The shunt capacitance and the series inductance form a matching network between the coaxial transmission line at its distal end and the radiating antenna element structure of the antenna. The shunt capacitance and the series inductance together match the impedance presented by the coaxial line, physically embodied as shield 16, insulative layer 17 and inner conductor 18, when connected at its proximal end to radiofrequency circuitry having a 50 ohm termination, this coaxial line impedance being matched to the impedance of the antenna element structure at its operating frequency or frequencies.

As stated above, the feed structure is assembled as a unit before being inserted in the antenna core 12, the laminate board 19 being fastened to the coaxial line 16-18. Forming the feed structure as a single component, including the board 19 as an integral part, substantially reduces the assembly cost of the antenna, in that introduction of the feed structure can be performed in two movements: (i) sliding the unitary feed structure into the bore 12B and (ii) fitting a conductive ferrule or washer around the exposed proximal end portion of the shield 16. The ferrule may be a push fit on the shield component 16 or is crimped onto the shield. Prior to insertion of the feed structure in the core, solder paste is preferably applied to the connection portions of the antenna element structure on the distal end face 12D of the core 12 and on the plating 22 immediately adjacent the respective ends of the bore 12B. Therefore, after completion of steps (i) and (ii) above, the assembly can be passed through a solder reflow oven or can be subjected to alternative soldering processes such as laser soldering, inductive soldering or hot air soldering as a single soldering step.

Solder bridges formed between (a) conductors on the peripheral and the proximal surfaces of the board 19 and (b) the metallised conductors on the distal face 12D of the core, and the shapes of the conductors themselves, are configured to provide balancing rotational meniscus forces during reflow soldering when the board is correctly orientated on the core.

Figure 8:
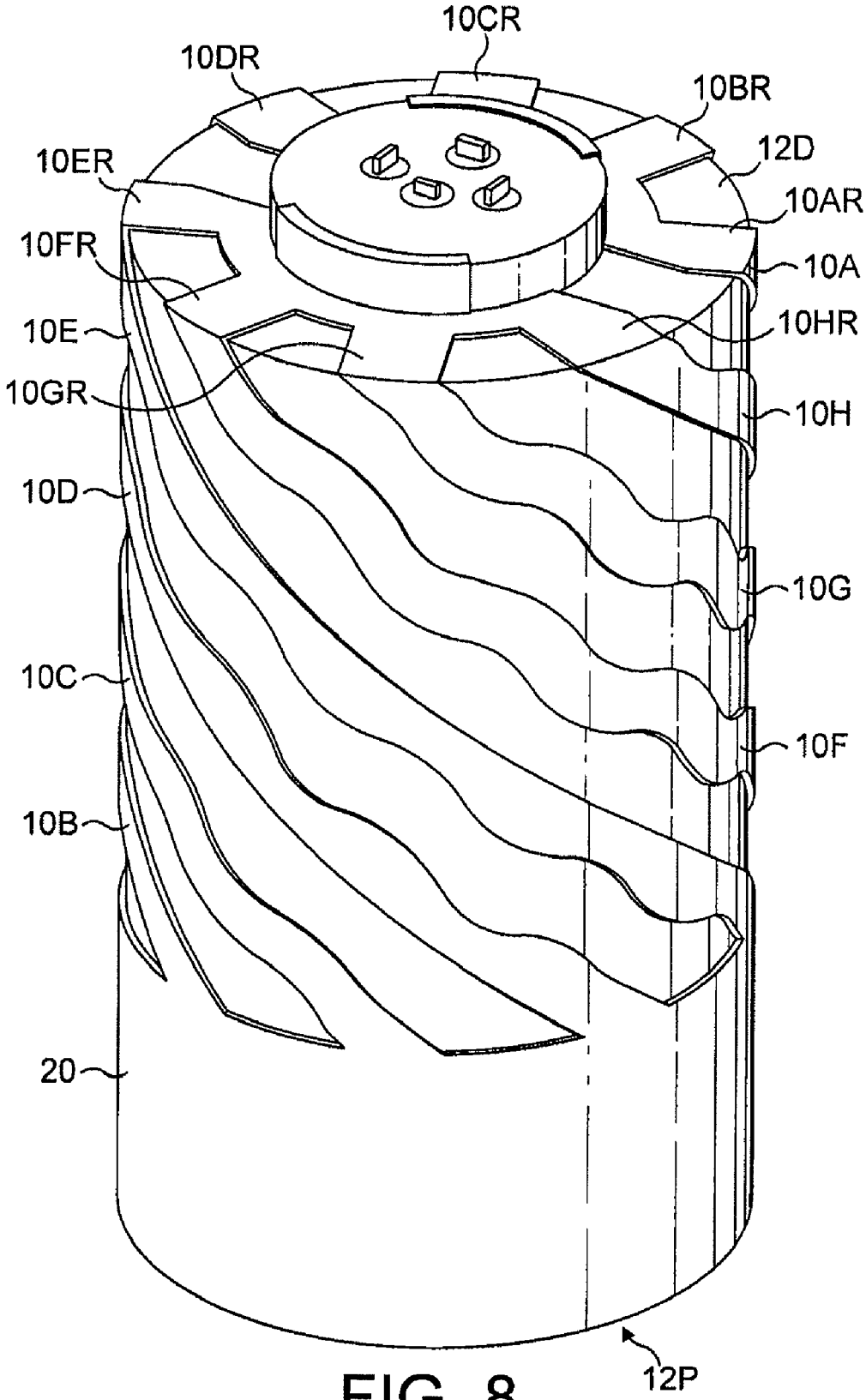
FIG. 8 is a perspective view of a second antenna in accordance with the invention.
Figure 9:
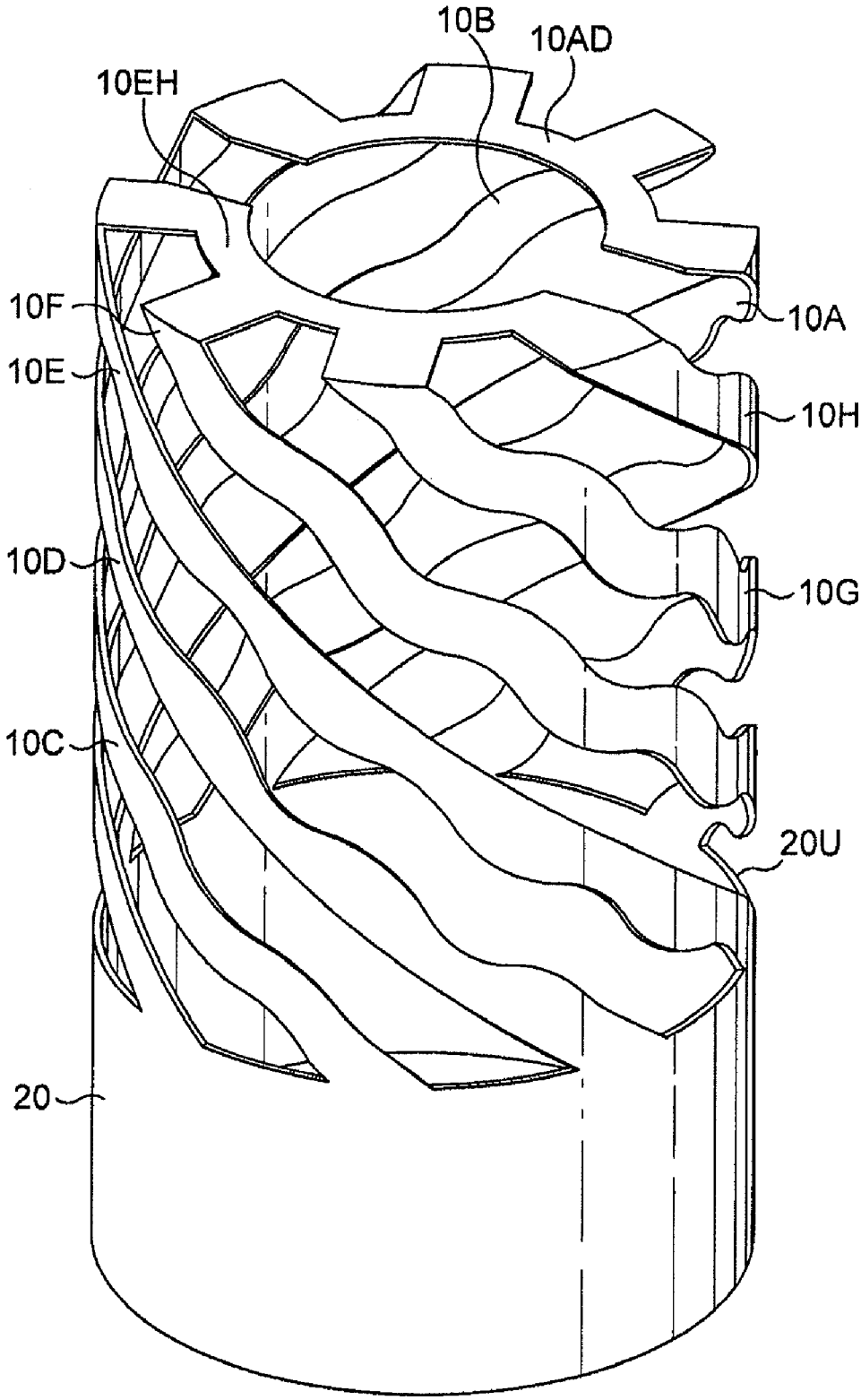
FIG. 9 is a see-through representation of a conductor pattern of the antenna of FIG. 8.

The antenna described above has antenna elements which are plain helices of different physical lengths spaced uniformly around a cylindrical core. Variations are possible within the scope of the invention. These include an antenna in which the physical lengths of the helical elements are equal and differences in loop lengths are achieved instead by arranging for the conductive connection portions 10AR-10HR plated on the distal end face 12D of the core to be of different effective lengths. Alternatively, the widths of the helical elements 10A-10H can be varied to yield different electrical lengths. It is also possible for the physical lengths of the helical elements and the electrical lengths of the loops represented by the laterally opposed pairs of helical elements and their interconnections also to be equal, the required response to circularly polarised electromagnetic waves and the associated radiation pattern being achieved solely as a result of the presence of a plurality of axially coextensive helical elements distributed around the core, especially with such elements being interconnected by an annular conductor such as sleeve 20 having an annular electrical length equal to the guide wavelength of the operating frequency, or a non-unity integral multiple thereof. One way of producing a variation in electrical length between successive members of each group 10A-10D, 10E-10H of helical elements is to arrange for the elements required to have a greater electrical length to be meandered. Indeed, all of the elements 10E-10H may be meandered, but to different degrees. It is possible for one or both edges of certain elements to be meandered as well. One such antenna is illustrated in FIGS. 8 and 9. The respective "unrolled" conductive pattern of the outer cylindrical surface portion of the antenna is shown in FIG. 10.

Figure 10:
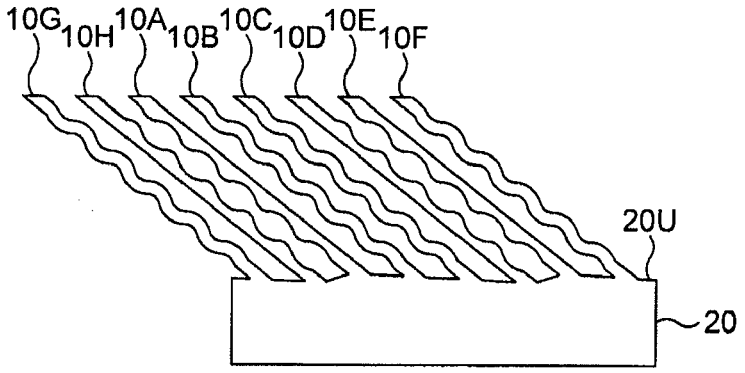
FIG. 10 is a representation of the conductor pattern on the outer cylindrical surface of the antenna of FIG. 8, transformed to a plane.

Referring to FIGS. 8 to 10, this second antenna in accordance with the invention, like the first antenna described above with reference to FIGS. 1 to 7, has eight helical antenna elements in the form of conductive tracks plated on the outer cylindrical surface portion of the core 12. As before, these helical elements are arranged in two groups 10A-10D, 10E-10H, the elements of each group being connected to respective radial tracks 10AR-10DR, 10ER-10HR and respective arcuate interconnecting tracks 10AD, 10EH, all plated on the distal face 12D of the core 12, as in the first embodiment. In this example, however, the helical elements of each group have meandered edges. As best seen in FIG. 10, the outer elements 10A, 10D; 10E, 10H of each group each have one edge meandered and the other edge as a plane helix, whereas the inner elements 10B, 10C; 10F, 10G of each group each have both edges meandered. The effect of such meandering is that the inner elements 10B, 10C; 10F, 10G have greater electrical lengths than the outer elements 10A, 10B; 10E, 10H. This arrangement is selected because, in this embodiment, the configuration of the radial connection tracks 10AR-10HR and their interconnecting arcuate conductors 10AD, 10EH is such that the electrical lengths of the conductive paths between the feed structure 16-19 and the distal ends of the outer helical elements 10A, 10D; 10E, 10H of each group are greater than those of the corresponding connections to the upper ends of the inner helical elements 10B, 10C; 10F, 10G. The meandering, therefore, compensates for the differences in electrical lengths of the conductors on the distal face 12D. In this example, the meandering is not used to effect differences in length between the helical elements 10A-10H for the purpose of creating phase differences, although, as stated above, it is possible to use meandering for this purpose. In this embodiment, it is the non-planar sleeve rim 20U that is used to effect a progression in helical element lengths, as in the first embodiment described above with reference to FIGS. 1 to 7.

The embodiments described so far are so-called "backfire" antennas inasmuch as they produce a radiation pattern directed outwardly from that end face of the antenna at which the radiating elements (the helical tracks and the respective connection conductors on the end face) are coupled to the feeder, the feeder comprising a transmission line passing through the core on the core axis. The invention is also applicable to an "endfire" antenna, the feed connection point of which is at the proximal end, i.e., the end opposite to that from which the antenna develops a maximum in the radiation pattern for circularly polarised waves. Such an antenna within the scope of the invention will now be described with reference to FIGS. 11 and 12.

Figure 11:
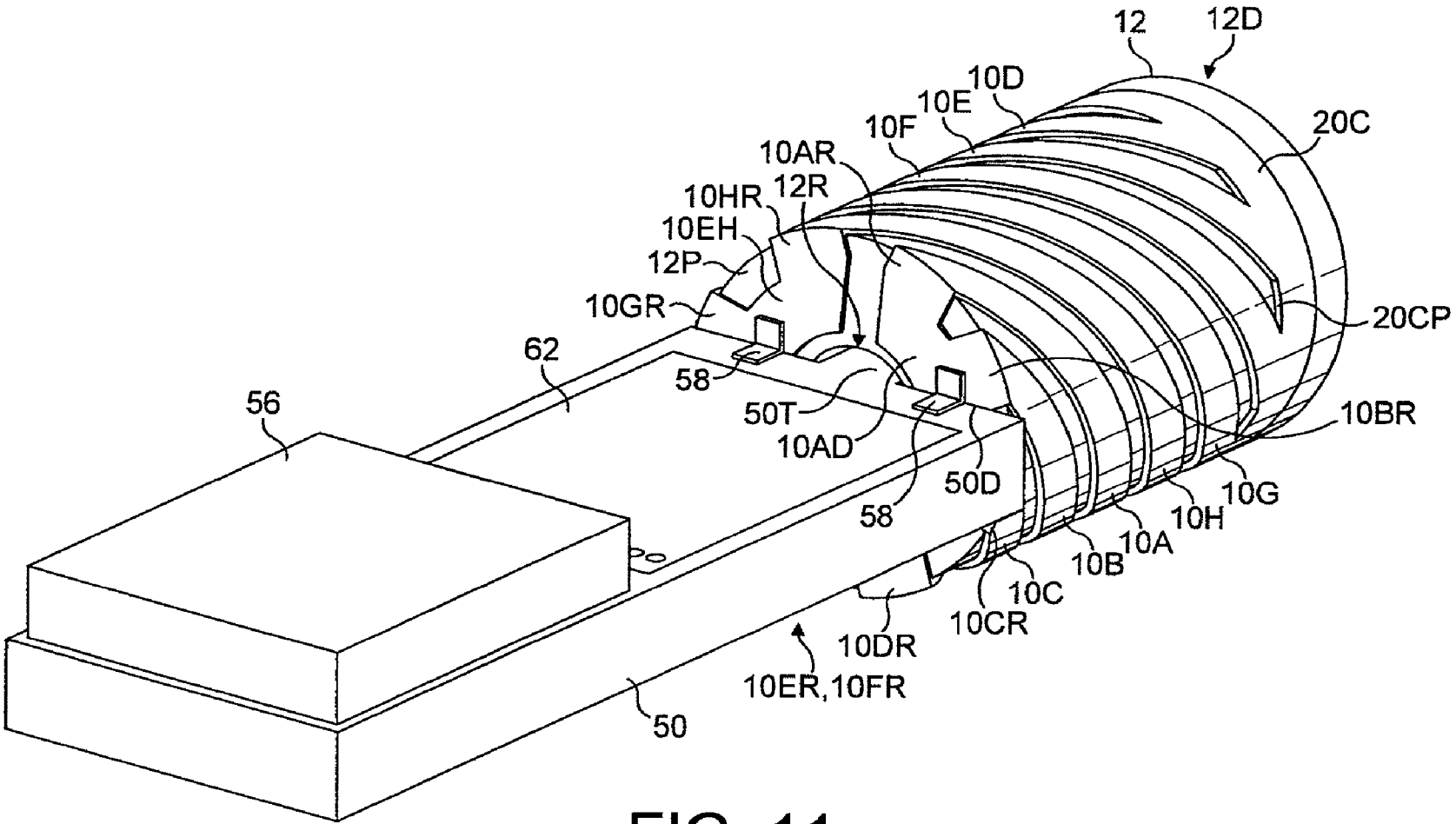
FIG. 11 is a perspective view of an assembly comprising a third antenna in accordance with the invention and a printed circuit board providing a balun and front-end receiver circuitry.

Referring to FIG. 11, a third antenna in accordance with the invention has an antenna element structure with eight longitudinally extending helical antenna elements 10A-10H, formed as plated metallic conductor tracks on the cylindrical outer surface portion of a cylindrical ceramic core 12. An annular link conductor 20C, positioned on the outer cylindrical surface of the core interconnects the antenna elements adjacent a distal end 12D of the antenna. At the proximal end 12P, eight radial connection elements 10AR-10HR, formed as metallic tracks, are plated on the proximal end surface of the core. Each radial element 10AR-10HR is electrically connected to a respective helical antenna element 10A-10H and, as in the above-described backfire antennas, is connected to the other radial elements associated with the antenna elements of the same group 10A-10D; 10E-10H by an arcuate interconnecting conductor track 10AD, 10EH located between the axis of the core and the edge of the end surface upon which they are plated.

The annular link conductor 20C acts as a common interconnecting conductor for the helical elements 10A-10H at their distal ends. The proximal edge 20CP of the linking conductor 20C may be non-planar to cause the lengths of the helical elements 10A-10H to vary in the same way that the sleeve rim 20U of the first and second antennas described hereinabove is non-planar. As before, the lengths of the helical elements 10A-10D, 10E-10H in each group alter progressively according to their angular position at the core axis, the elements 10A, 10E being the longest in each group 10A-10D, 10E-10H, and the elements 10D, 10H being the shortest. The electrical length of the annular linking conductor 20C equals the guide wavelength at the operating frequency of the antenna so that this linking conductor has a ring resonance as described above with reference to the sleeve rim 20U of the first and second antennas (see FIGS. 1 to 4 and 8 to 9). As in the case of the backfire antennas described above, other steps may be taken to vary the lengths of the helical elements 10A-10H and their interconnecting conductors, as required.

Figure 12:
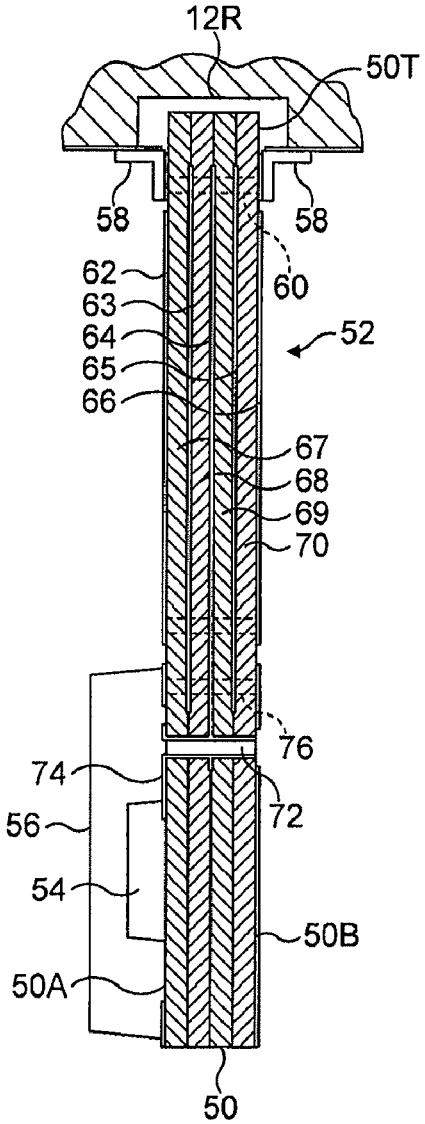
FIG. 12 is an axial cross-section of the printed circuit board of the assembly of FIG. 11 and part of the antenna to which it is mounted.

The core 12 of the antenna shown in FIG. 11 has no central passage but merely a circular recess 12R in the proximal end face 12P, centred on the core axis. This recess 12R receives a central tab 50T projecting from the distal edge of a multiple layer printed circuit board (PCB) 50 mounted to the proximal end face 12P of the antenna core 12, as shown most clearly in FIG. 12. Referring to FIG. 12, the PCB 50 has multiple electrically conductive layers and multiple insulative layers separating the electrically conductive layers, the conductive patterns of the layers being configured to form a balun 52 connected to the coupling nodes of the antenna formed by the arcuate conductor tracks 10AD, 10EH on the proximal end face 12P of the antenna core 12. The PCB carries a receiver front end circuit comprising a front end amplifier 54 housed within a screen 56 on one major face 52A of the PCB 52.

Connections between the balun 52 and the coupling nodes 10AD, 10EH of the antenna are made by four conductive brackets 58, two on each major face 50A, 50B of the PCB 50, adjacent the distal edge 50D of the PCB 50. In practice, the PCB 50 is secured to the antenna core 12 by a plastics collar, not shown in the drawings.

In this embodiment, the PCB 50 is centrally positioned with its major faces 50A, 50B parallel to the axis. The central plane of symmetry of the PCB 50, parallel to and between the major faces 50A, 50B, bisects the proximal end face 12P of the antenna core on a diameter perpendicular to a line on the end face 12P passing between the two sets of radial elements 10AR-10DR; 10ER-10HR and their interconnecting arcuate conductors 10AD, 10EH so that the distal edge 50D of the PCB 50 overlaps both arcuate interconnecting conductors 10AD, 10EH. The brackets 58 are located in registry with the respective interconnecting conductors 10AD, 10EH. Thus, each coupling node of the antenna is connected to the balun 52 by two respective connecting brackets 58, one on each side of the PCB 50. Each such pair of connecting brackets 58 is linked by a respective plated through-hole (via) 60 passing through the PCB 50 (see FIG. 12).

The PCB 50 has five conductive layers 62, 63, 64, 65, 66 separated by four insulative layers 67, 68, 69, 70. The middle or third conductive layer 64 is formed as a narrow conductive track extending along the axis of the antenna from one of the vias 60 interconnecting the conductive brackets 58 which are conductively bonded to the arcuate interconnecting conductor 10EH, this elongate conductive track acting as the inner conductor of a shielded transmission line, the shield of which is formed by the two intermediate conductive layers 63, 65 which extend parallel to the track formed by the middle layer 64 and have vias (not shown) along their longitudinal edges to interconnect those edges along lines parallel to but spaced from the edges of the inner conductor 64. The intermediate conductive layers 63, 65 forming the transmission line shield are connected to the conducting brackets 58 which overlie the arcuate interconnecting conductor 12AD on the antenna distal end face 12P, thereby connecting the transmission line as a feeder for the radiating antenna element structure of the antenna.

As will be seen from FIG. 12, the proximal ends of the transmission line conductors formed by layers 63, 64, 65 extend to the receiver circuitry and, specifically, has a via connection 72 to an input 74 of the amplifier 54, the shield conductors 63, 65 being connected by another via 76 to the amplifier ground and the screen 56.

The outer conductive layers 62, 66 of the PCB 50 are formed as conductive plates extending substantially the full width of the PCB and, thereby, overlapping the shield conductors formed by the intermediate layers 63, 65. The distal edges of the plates formed by outer layers 62, 66, i.e. the edges closest to the antenna, are open-circuit edges. In contrast, the proximal edges are interconnected by a line of vias 78 extending transversely of the PCB, these vias also connecting the proximal edges of the plates to the shield conductors formed by the intermediate layers 63, 65. The relative dielectric constant of the insulative layers 67, 70 between the plates 62, 66 and the shield conductors 63, 65, and the axial lengths of the plates 62, 66 are such that the electrical lengths of the plates 62, 66 in the axial direction are each a quarter guide wavelength at the operating frequency of the antenna. The PCB 50 thereby provides a balun matching the single-ended input of the receiver circuitry with the balanced feed connection of the antenna at the coupling nodes provided by the arcuate interconnecting conductors 10AD, 10EH.

This arrangement has several benefits. Firstly, the balun 52 chokes currents on the shield conductors formed by the intermediate layers 63, 65, thereby preventing common-mode noise signals (generated, e.g., by other circuits in the equipment in which the antenna is mounted) flowing off the screen cage and entering the transmission line formed by the inner and intermediate layers 63-65. In this manner the balun screens the transmission line from common-mode noise signals. The balun provides a balanced load for the antenna. Furthermore, the balun isolates the antenna such that only the antenna radiates. In addition, the resonant frequency of the system is determined by the antenna only, rather than the antenna together with exposed conductors of the link between the antenna and the receiving circuit. This means that the radiating and resonating conductor lengths are consistent.

As an alternative, the current choke can be formed by a half balun sleeve. In such an arrangement, only one balun plate is used. This has substantially the same effect as a full balun sleeve formed by two plates (layers 62, 66 in FIG. 12).

Figure 13:
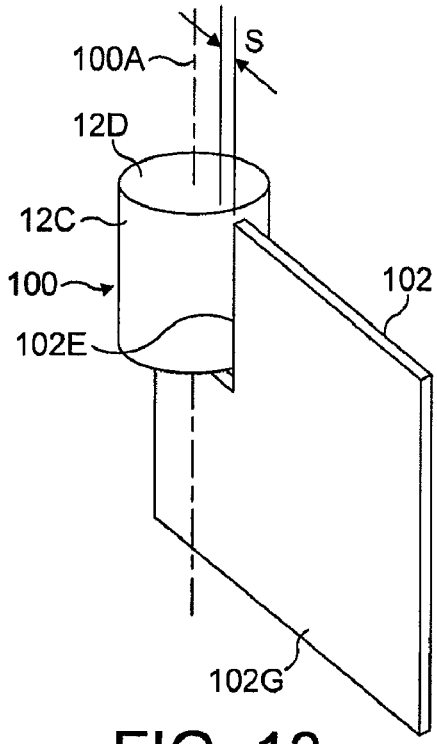
FIG. 13 is a diagrammatic perspective view of a portable wireless terminal in accordance with the invention.

One advantage of the octafilar antennas described above is that they may be placed closer to conductive structures without appreciable detuning. Referring to FIG. 13, a portable wireless terminal in accordance with one aspect of the invention has an antenna 100 located inside the terminal casing (not shown) and mounted adjacent an edge 102E of a planar printed circuit board 102 which has an electrically conductive ground plane layer 102G. The edge 102E of the board 102 and that of the ground plane layer 102G lies parallel to the outer cylindrical surface 12C of the antenna core, upon which the helical elements 10A-10H (see FIG. 1) are plated and is spaced therefrom by a distance s which, in this embodiment, is in the region of 1 mm. The ground plane layer is spaced from the cylindrical surface 12C by s over substantially the whole of the longitudinal or axial extent of the antenna structure formed by the helical elements. It will be noted that the ground plane layer 102G lies in a plane containing the axis 100A of the antenna or, at least, in a plane which is very close to and parallel to the axis 10A.

The lack of detuning is thought to be due to the fact that, at the most sensitive parts of the helical antenna elements 10A-10H (FIG. 1), only one element out of the eight is affected by the proximity of the ground plane conductive layer 102G. This represents a small percentage of the total complement of helical antenna elements compared with, for instance, one affected helical element of a quadrifilar helical antenna.

Figure 14:
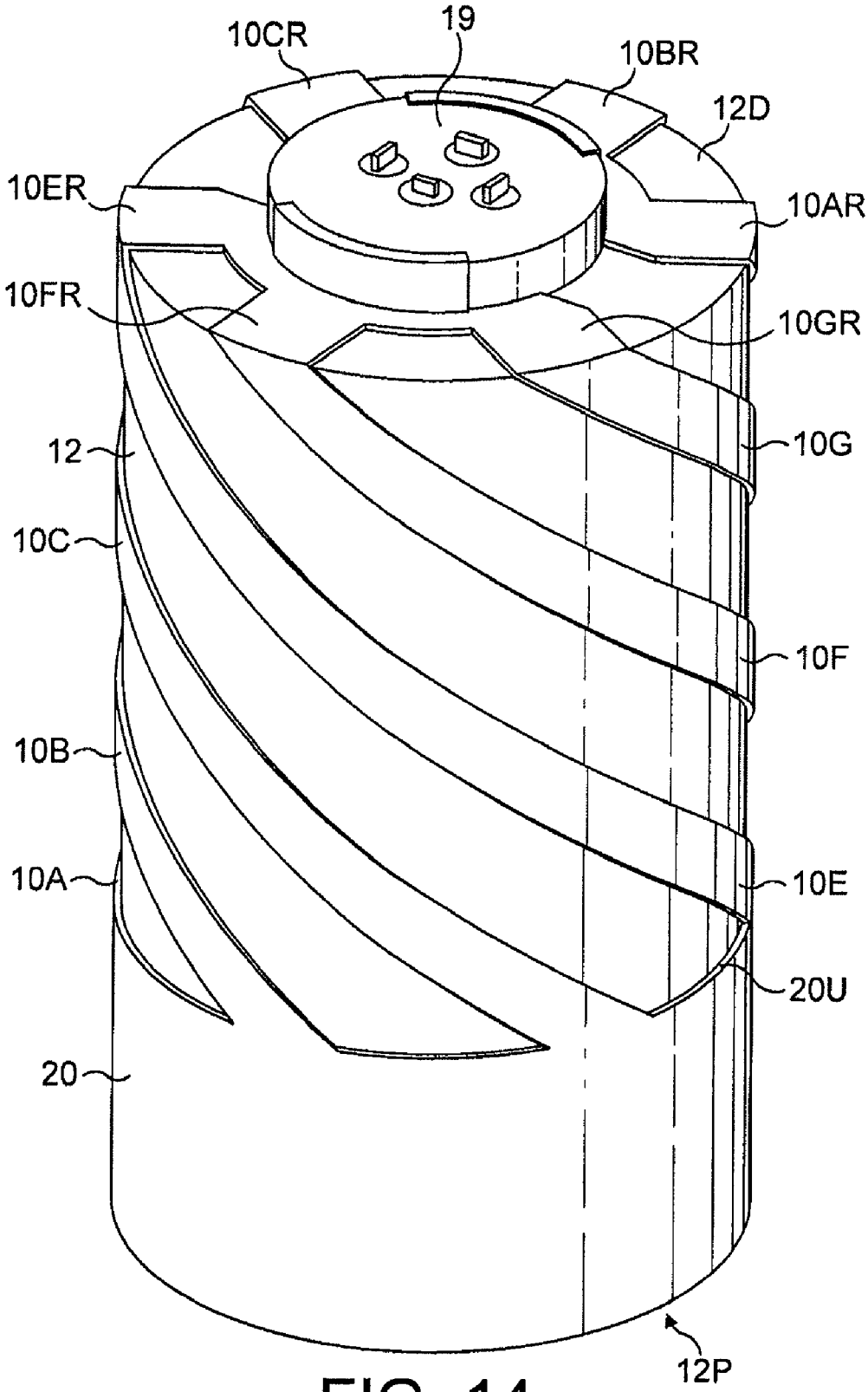
FIG. 14 is a perspective view of a second antenna in accordance with the invention.

A further antenna in accordance with the invention has three pairs of helical antenna elements, as shown in FIG. 14. Referring to FIG. 14, in this hexafilar antenna the helical elements are, as in the case of the octafilar antenna described above, arranged in two groups, the elements of each group being connected to a respective coupling node. Thus, three coextensive helical conductive tracks 10A, 10B, 10C plated or otherwise metallised on the cylindrical outer surface of the cylindrical core 12 are coupled to one side of the feeder via radial tracks 10AR, 10BR, 10CR, and a further three helical tracks 10E, 10F, 10G are coupled to the other side of the feeder by respective radial tracks 10ER, 10FR, 10GR. As before, two arcuate conductors 10AC, 10EG plated on the core distal face 12D adjacent the end of the board 12B interconnect the respective radial tracks in order that coupling to the feeder shield and inner conductors may be achieved via the laminate board 19 described above.

The helical tracks 10A-10C, 10E-10G are uniformly angularly spaced around the axis at 120° intervals, a combined circular polarisation resonance being achieved in a manner similar to that described above in connection with the octafilar antenna by varying the individual electrical lengths of the loops formed by the paired elements 10A, 10E; 10B, 10F; 10C, 10G. It has been found that the physical lengths of the helical elements 10A-10C, 10E 10G are advantageously shorter in the case of the outer elements 10A, 10C, 10E, 10G of the two groups than the middle or inner conductor tracks 10B, 10F. A suitable profile for the balun rim 20U is shown diagrammatically in FIG. 5. It will be appreciated that, in this diagram, the magnitude of the height variations of the rim 20U is greatly magnified for clarity of illustration of the principle.

Figure 15:
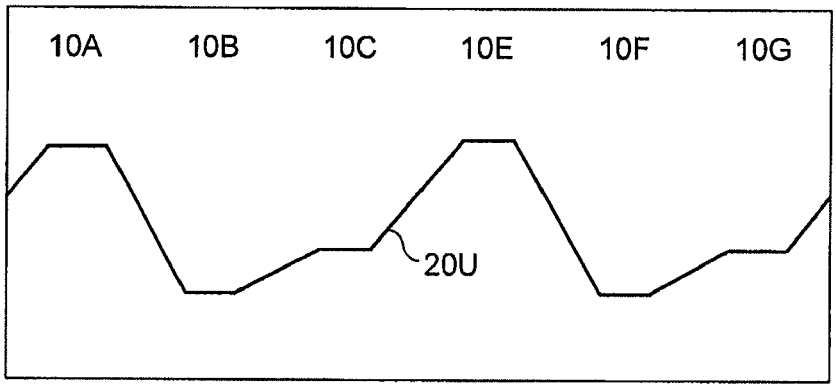
FIG. 15 is a diagram illustrating a balun rim profile of the antenna of FIG. 14.

A particular property of a hexafilar antenna such as that described above with reference to FIGS. 14 and 15 is that its bandwidth is greater than the bandwidth of comparable quadrifilar and octafilar antennas. This is because the pair of inner helical tracks may be regarded as a bifilar loop, the hexafilar antenna constituting the combination of a quadrifilar antenna and a bifilar antenna. The resonant bandwidth of a bifilar loop is greater than that of the combination of two loops in a quadrifilar arrangement, because the resonance of a quadrifilar arrangement, for circular polarisation, depends on a particular phase relationship that exists only over a narrow band of frequencies.

Figure 16:
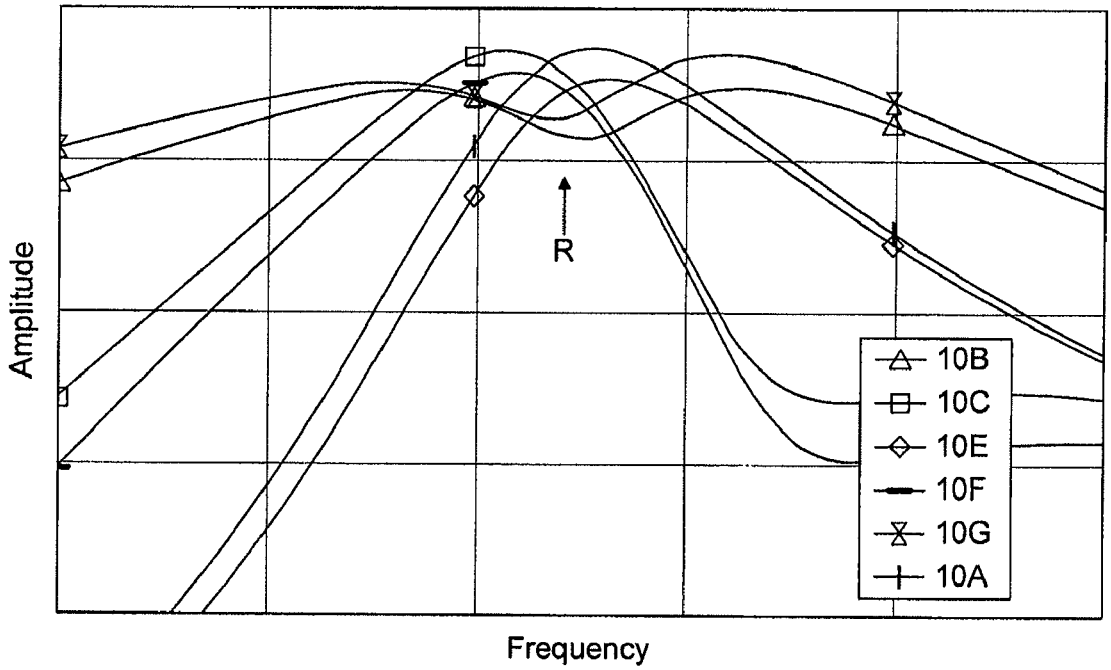
FIG. 16 is a graph illustrating individual frequency responses of conductor tracks of the antenna of FIG. 14.

The bifilar resonance couples with those of the outer tracks so as to broaden the combined circular polarisation resonance. This is shown in the graph of FIG. 16 which is a plot of the amplitudes of individual voltages on the helical conductor tracks 10A-10C, 10E-10G with respect to frequency. These plots are obtained by capacitive probes mounted close to the junctions of the respective tracks with the balun rim 20U, in a manner similar to that described in our U.S. Pat. No. 6,886,237. It will be noted that the inner tracks 10B, 10F exhibit a broad resonance and, in particular, exhibit a dip or "saddle" in the region R of the intersection of the responses of the outer elements 10A, 10C, 10E, 10G, as shown in FIG. 16. This is evidence of the sharing of energy, i.e. coupling, between the elements at the frequency of operation of the antenna.

With the antenna described and shown, a 3 dB fractional bandwidth of at least 1% can be expected, with a figure of 1.2%.

What is claimed is:

1. A dielectrically-loaded antenna having an operating frequency in excess of 200 MHz comprising: an electrically insulative core of a solid material that has a relative dielectric constant greater than 5 and occupies the major part of the interior volume defined by the core outer surface, and a three-dimensional antenna element structure that is on or adjacent the core outer surface and that comprises at least three pairs of elongate conductive antenna elements, the antenna elements being substantially axially coextensive and substantially uniformly spaced apart around an axis of the antenna and arranged to cooperate to form a common circular polarization resonance at the operating frequency.

2. An antenna according to claim 1, further comprising a pair of antenna element coupling nodes, each said pair of antenna elements having one antenna element connected to one of the coupling nodes and another antenna element connected to the other coupling node.

3. An antenna according to claim 2, wherein the said elongate conductive antenna elements are of substantially equal length.

4. An antenna according to claim 2, wherein the antenna element structure includes a common interconnecting conductor which encircles the core on its outer side surface portion, each said elongate antenna element having a first end connected to a respective one of the coupling nodes and a second end connected to the common interconnecting conductor, wherein the lengths of the said elongate antenna elements on the outer side surface portion of the core are substantially equal, and wherein the electrical length of an annular conductive path defined by the common interconnecting conductor is substantially equal to a whole number (1, 2, 3, . . . ) of guide wavelengths corresponding to the operating frequency.

5. An antenna according to claim 4, wherein each of the elongate elements comprises a conductive track on the core outer side surface portion, each such track comprising a pure helix.

6. An antenna according to claim 1, wherein the antenna element structure includes a common interconnecting conductor to which each of the said antenna elements is connected and which encircles the core on its outer side surface portion, the common interconnecting conductor defining a conductive path around the core to which the antenna elements are connected at substantially equally spaced connection points.

7. An antenna according to claim 6, wherein the electrical length of the said conductive path is substantially equal to a whole number (1, 2, 3, . . . ) of guide wavelengths corresponding to the said operating frequency.

8. An antenna according to claim 7, wherein the common interconnecting conductor is an annular conductive track both edges of which are on the outer side surface portion of the core.

9. An antenna according to claim 8, wherein the core has a central axis and proximal and distal outer surface portions extending transversely with respect to the axis, the outer side surface portion extending between the proximal and distal outer surface portions, wherein the antenna further comprises a feeder structure including a feeder transmission line extending in an axial direction through the core between the proximal and distal surface portions of the core and coupled to first ends of the said elongate antenna elements by coupling conductors on or adjacent the distal surface portion of the core, and wherein the common interconnecting conductor is a conductive sleeve having a distal rim to which the antenna elements are connected at their second ends, the sleeve being connected to the feeder transmission line at or adjacent the proximal surface portion of the core by a conductive layer on the proximal surface portion.

10. An antenna according to claim 6, wherein the antenna elements connected to each said coupling node comprise a group of antenna elements spaced apart laterally with respect to each other and having two outer elements and at least one inner element between the outer elements, the or each inner element having a greater length than the outer elements.

11. An antenna according to claim 10, wherein the inner elements have meandered edges.

12. An antenna according to claim 10, wherein the inner elements are of a different width from, preferably narrower than the outer elements.

13. An antenna according to claim 6, further comprising a pair of antenna element coupling nodes, each said pair of antenna elements having one antenna element connected to one of the coupling nodes and another antenna element connected to the other coupling node, wherein the core is cylindrical and has first and second oppositely directed end surface portions extending perpendicularly to the cylinder axis, wherein the coupling nodes each comprise a conductive layer portion on or adjacent the first end surface portion at an inner radius, and wherein each antenna element is connected to one or other of the conductive layer portions by a respective radially extending coupling conductor on or adjacent the first end surface portion.

14. An antenna according to claim 13, wherein each said conductive layer portion has a constant-radius arcuate outer edge and subtends an angle of at least 105° at the axis.

15. An antenna according to claim 1, wherein each said pair of elongate antenna elements has an associated resonance within a single operating frequency band of the antenna.

16. An antenna according to claim 1, wherein each of the elongate antenna elements comprises a helical conductive track executing a half turn about a common central axis.

17. An antenna according to claim 1, wherein the antenna element structure comprises an odd number of pairs of elongate conductive antenna elements.

18. An antenna according to claim 17, wherein the elongate conductive antenna elements of each pair are laterally opposed with respect to each other with the axis of the antenna between them so as to form two laterally opposed groups of antenna elements, each group having a corresponding odd number of antenna elements, and wherein a middle antenna element of each group has an associated resonance at a frequency which is midway between the frequencies of resonance associated respectively with the antenna elements of the group which are on each respective side of the middle element.

19. An antenna according to claim 17, wherein the antenna element structure has three said pairs of elongate conductive antenna elements.

20. An antenna according to claim 1, wherein the antenna element structure has four said pairs of elongate conductive antenna elements.

21. A dielectrically-loaded antenna having an operating frequency in excess of 200 MHz comprising: an electrically insulative core of a solid material that has a relative dielectric constant greater than 5 and occupies the major part of the interior volume defined by the core outer surface, and a three-dimensional antenna element structure that is on or adjacent the core outer surface and that comprises at least three pairs of elongate conductive antenna elements, the antenna elements being substantially axially coextensive and substantially uniformly spaced apart around an axis of the antenna, and a pair of antenna element coupling nodes, each said pair of antenna elements having one antenna element connected to one of the coupling nodes and another antenna element connected to the other coupling node, wherein each elongate antenna element has a first end coupled to its respective coupling node and a second end spaced from the first end, the element being dimensioned to yield a predetermined electrical path length between the respective coupling node and the second end, and wherein the elongate antenna elements coupled to each node form a group of neighbouring elements which are arranged so as to be angularly spaced apart with respect to the axis and such that their respective said electrical path lengths differ and thereby form a monotonic progression, the sense of the progression being the same for each group.

22. A dielectrically-loaded antenna having an operating frequency in excess of 200 MHz comprising: an electrically insulative core of a solid material that has a relative dielectric constant greater than 5 and occupies the major part of the interior volume defined by the core outer surface, and a three-dimensional antenna element structure that is on or adjacent the core outer surface and that comprises at least three pairs of elongate conductive antenna elements, the antenna elements being substantially axially coextensive and substantially uniformly spaced apart around an axis of the antenna, and a pair of antenna element coupling nodes, each said pair of antenna elements having one antenna element connected to one of the coupling nodes and another antenna element connected to the other coupling node, wherein each elongate antenna element of each said pair has a first end coupled to the respective one of the coupling modes and a second end which is linked to the second end of the other elongate antenna element of the pair to form at least a part of a conductive loop that is generally symmetrical about the axis and that has a predetermined resonant frequency, and wherein the loops formed by the said pairs of elongate antenna elements are angularly distributed with respect to the axis, the respective resonant frequencies of the loops varying monotonically with angular orientation.

23. An antenna according to claim 22, wherein the second ends of the elongate antenna elements are linked by a common interconnecting conductor encircling the core such that their second ends are defined by the connections of the elements to a common angular edge of the interconnecting conductor, which edge, in terms of its axial position, varies in height non-monotonically across each said group of elongate antenna elements.

24. A dielectrically-loaded antenna having an operating frequency in excess of 200 MHz comprising: an electrically insulative core of a solid material that has a relative dielectric constant greater than 5 and occupies the major part of the interior volume defined by the core outer surface, and a three-dimensional antenna element structure that is on or adjacent the core outer surface and that comprises at least three pairs of elongate conductive antenna elements, the antenna elements being substantially axially coextensive and substantially uniformly spaced apart around an axis of the antenna, and a pair of antenna element coupling nodes, each said pair of antenna elements having one antenna element connected to one of the coupling nodes and another antenna element connected to the other coupling node, wherein the antenna element structure includes a common interconnecting conductor that encircles the core on its outer side surface portion, each said elongate antenna element having a first end connected to a respective one of the coupling nodes and a second end connected to the common interconnecting conductor at an edge thereof, wherein the antenna has a central axis, the first ends of the elongate antenna elements lie in a first plane perpendicular to the axis, and the said edge of the common interconnecting conductor follows a non-planar path that extends on both sides of a second plane that is parallel to and spaced from the first plane, the path being non-planar in that it is inclined or progressively stepped in a first direction between each of the antenna elements of each group of antenna elements connected at their first ends to a respective one of the coupling nodes, and inclined or stepped in the opposite direction between the groups, whereby the antenna elements of each group are of progressively increasing length in one direction of rotation about the axis.

25. A portable wireless communication terminal including:

a dielectrically-loaded antenna having an operating frequency in excess of 200 MHz comprising: an electrically insulative core of a solid material that has a relative dielectric constant greater than 5 and occupies the major part of the interior volume defined by the core outer surface, and a three-dimensional antenna element structure that is on or adjacent the core outer surface and that comprises at least three pairs of elongate conductive antenna elements, the antenna elements being substantially axially coextensive and substantially uniformly spaced apart around an axis of the antenna; and a generally planar circuit board having an electrically conductive layer, wherein the said layer has an edge adjacent the said antenna element structure and extends generally radially outwardly from the core with respect to the axis.

26. A portable terminal according to claim 25, wherein the conductive layer lies in a plane generally parallel to the antenna axis.

27. A portable terminal according to claim 25, wherein the conductive layer lies in a plane containing the antenna axis.

28. A portable terminal according to claim 25, wherein the conductive layer is a ground plane conductor which extends to within 3 mm of the antenna element structure.

* * * * *